US005865357A

United States Patent [19]

Goodwin

[11] Patent Number: 5,865,357

[45] Date of Patent: Feb. 2, 1999

[54] BELT CLIP FOR CONCEALED CONTAINER

[76] Inventor: Robert Booth Goodwin, 79 Main St., Queensbury, N.Y. 12804

[21] Appl. No.: 728,153

[22] Filed: Oct. 9, 1996

[51] Int. Cl.[6] ..... A45F 5/00; F41C 33/02

[52] U.S. Cl. ..... 224/587; 224/666; 224/667; 224/679; 224/911

[58] Field of Search ..... 224/587, 666, 224/669, 667, 269, 679, 911; 24/3.12, 182

[56] References Cited

U.S. PATENT DOCUMENTS

| | | | |
|---|---|---|---|
| D. 273,821 | 5/1984 | Bianchi | D2/400 |
| 460,447 | 9/1891 | Rosenberger | 24/182 |
| 837,824 | 12/1906 | Gibson | 224/666 |
| 1,063,739 | 6/1913 | Sanders | 24/182 |
| 2,775,804 | 1/1957 | Ayoub | 24/3.12 |
| 2,917,213 | 12/1959 | Rucheimer et al. | 224/911 |
| 3,027,995 | 4/1962 | Littman | 206/38 |
| 3,118,580 | 1/1964 | Manshel | 224/911 |
| 3,250,448 | 5/1966 | Clark . | |
| 3,379,349 | 4/1968 | Hier . | |
| 3,583,612 | 6/1971 | Theodore . | |
| 3,589,574 | 6/1971 | Marburger | 224/911 |
| 3,707,250 | 12/1972 | Esposito . | |
| 3,894,667 | 7/1975 | Baldocchi . | |
| 3,915,361 | 10/1975 | Perkins . | |
| 4,022,361 | 5/1977 | Devlin . | |
| 4,165,826 | 8/1979 | Chica | 224/191 |
| 4,253,592 | 3/1981 | Anderson | 224/198 |
| 4,342,410 | 8/1982 | Sloan . | |
| 4,358,036 | 11/1982 | Maltais | 224/667 |
| 4,667,374 | 5/1987 | Bianchi . | |
| 4,690,315 | 9/1987 | Bianchi . | |
| 4,741,465 | 5/1988 | Johnson . | |
| 4,750,656 | 6/1988 | Bianchi et al. . | |
| 4,787,540 | 11/1988 | Barry | 224/192 |
| 4,830,247 | 5/1989 | Banks . | |
| 5,265,781 | 11/1993 | Nichols | 224/667 |
| 5,294,031 | 3/1994 | Volpei et al. . | |
| 5,312,029 | 5/1994 | Tuber | 224/666 |

*Primary Examiner*—Linda J. Sholl
*Attorney, Agent, or Firm*—Heslin & Rothenberg, P.C.; Wayne F. Reinke

[57] ABSTRACT

A belt clip for holding a container, such as a fire arm holster, inside the waistband of a pair of pants includes a straight member, a top hook member and a bottom hook member. The hook members hold the top and bottom, respectively, of a belt worn by a user. A gap between the hook members allows the belt clip and container to be attached and removed from the belt while the belt is being worn. The belt clip may be adjustable to accommodate different sized belts.

14 Claims, 3 Drawing Sheets

BELT CLIP FOR CONCEALED CONTAINER

BACKGROUND OF THE INVENTION

1. Technical Field

The present invention generally relates to belt clips. More particularly, the present invention relates to belt clips for holding a container inside the waistband of a pair of pants.

2. Background Information

In the past, belt clips for holding fire arm holsters have suffered various shortcomings. For example, the holsters have been held to the belt by some form of closed loop, causing the belt to have to be removed from the belt loops on the pants in order to put on or take off the holster. As another example, closed loops with a snap closure have been used. Although these types of belt clips alleviate the need to remove the belt, they rely on the snap to hold the holster to the belt. Such snaps can degrade over time, and may be difficult to open and close, since a strong snap would be needed. As still another example, flexible spring clips have been used to hold the holster to the belt. Such spring clips rely on a friction fit to retain the holster. Although spring clips remove the need to operate a closure mechanism, they are far less secure than either of the other belt clip types mentioned above.

Thus, a need exists for an improved belt clip that is both secure and able to be attached to and removed from a belt while the belt is being worn.

SUMMARY OF THE INVENTION

Briefly, the present invention satisfies the need for an improved belt clip by providing a belt clip with top and bottom hooks and a gap between them, such that the belt is securely held, while allowing the clip to be attached and removed without removing the belt.

In accordance with the above, it is an object of the present invention to provide an improved belt clip.

It is a another object of the present invention to provide a belt clip that secures to a belt, while allowing the belt clip to be attached and/or removed from the belt while the belt is being worn.

The present invention provides, in a first aspect, a belt clip for holding a container inside the waistband of a pair of pants worn by a user wearing a belt. The belt clip comprises a straight member, a top hook member coupled to the straight member at a top thereof for holding onto the belt at a top thereof, and a bottom hook member coupled to the straight member at a bottom thereof for holding onto the belt at a bottom thereof. A gap exists between the top hook member and the bottom hook member such that the belt clip is attachable and removable from the belt while the belt is being worn.

The present invention provides, in a second aspect, a concealed holder for inside the waistband of a pair of pants worn by a user wearing a belt. The concealed holder comprises a container for concealing inside the waistband, and a belt clip of the first aspect coupled to the container by a coupling member for holding onto the belt.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
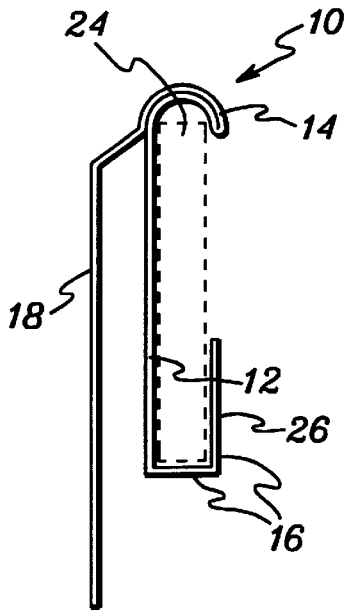
FIG. 1 is a side view of a belt clip in accordance with a first exemplary embodiment of the present invention.

FIG. 1 is a side view of a belt clip 10 in accordance with a first exemplary embodiment of the present invention. Belt clip 10 comprises a straight member 12, a top hook member 14 and a bottom hook member 16. Top hook member 14 is curved, while bottom hook member 16 is L-shaped or squared. Also shown in FIG. 1 is another member 18 that is part of a concealed container (see FIG. 4), which resides inside the waistband 19 of a pair of pants (see FIG. 7). A gap 20 is present between top hook member 14 and bottom hook member 16. A coupling member 22 couples belt clip 10 with container member 18.

Preferably, the size of belt clip 10 (e.g., the length of straight member 12) corresponds approximately to that of a belt 24 (shown in broken lines) to be used with clip 10. The size correspondence could be actual or accomplished by providing an adjustable construction for belt clip 10. Top hook member 14 wraps over the top of the belt, while bottom hook member 16 holds the bottom of the belt. Since belts are typically somewhat flexible (e.g., leather), gap 20 is such that clip 10 can be attached and removed therefrom while it is being worn. However, gap 20 is not so large that belt clip 10 slips off of belt 24. In addition, the larger member 26 of bottom hook member 16 could be curved from the edge of the clip toward the center (see FIG. 4), in order to assist the attachment and removal thereof from belt 24, while not compromising its ability to stay clipped to the belt.

Preferably, belt clip 10 is formed from a single piece of material that is or becomes flexibly rigid, such as, for example, thermoforming plastic. However, it will be understood that the present invention does not require that the belt clip be formed from a single piece of material. As shown in FIG. 1, top hook member 14 comprises two layers folded onto one another by, for example, using an appropriate cement, adhesive or other bonding agent (collectively, "adhesive"). The choice of material will depend on the purpose for the belt clip, and the choice of adhesive will depend on the material used, as well as the purpose for the belt clip. For example, if the belt clip is to be used with a fire arm holster, the material and adhesive is preferably resistant to degradation from oil and solvents, as well as soil resistant to prevent damage from abrasive action of drawing and re-holstering. The resistance to degradation from oil and solvents is preferred, because leather and some plastics degrade from contact therewith for extended periods of time. However, it is recognized that some amount of oil and solvents will generally remain on the surface of a fire arm after cleaning or maintenance. Resistance to water is also desirable, due to the potential for contact with perspiration from the user. Although belt clip 10 and container member 18 are shown in FIG. 1 as a continuous piece of material, it will be understood that they could be separate.

Figure 2:
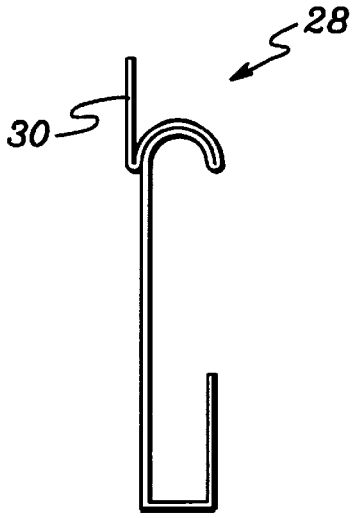
FIG. 2 is a side view of another a belt clip in accordance with a second exemplary embodiment of the present invention.

FIG. 2 is a side view of another belt clip 28 in accordance with a second exemplary embodiment of the present invention. Belt clip 28 is similar to belt clip 10 in FIG. 1, except that it is separated from any container and the bottom hook member is not tapered (see FIG. 5). Coupling member 30 can be connected to a container by, for example, riveting member 30 thereto (see FIG. 5). Alternatively, belt clip 28 could be removably connectable to one or more than one container by, for example, Chicago screws, snaps, or hook and loop fasteners. In this way, a single clip could be used with different concealed containers having different purposes.

An inside-the-waistband concealed container has many uses besides as a fire arm holster, such as, for example, a speedloader case, pistol magazine case, handcuff case, flashlight case, collapsible baton case, personal defense spray case, wallet case, stun gun holster, portable radio case, and knife sheath are desirable, to name a few. Any situation in which concealment of something held by a person provides an opportunity to use the present invention.

Figure 3:
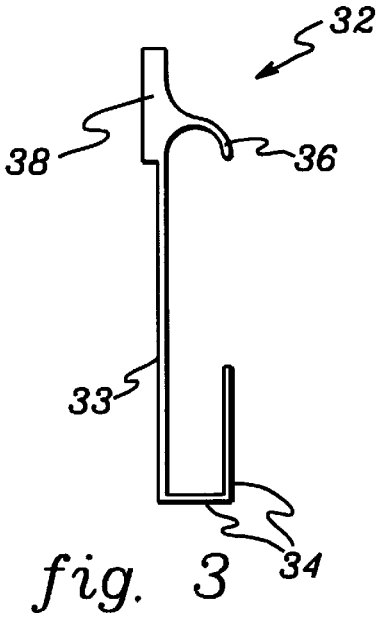
FIG. 3 is a side view of still another belt clip in accordance with a third exemplary embodiment of the present invention.

FIG. 3 is a side view of another belt clip 32 in accordance with a third exemplary embodiment of the present invention. Although the straight member 33 and bottom hook member 34 are similar to the corresponding portions of belt clip 28 in FIG. 2, the top hook member 36 and coupling member 38 are different. Top hook member 36 is solid, rather than layered, and coupling member 38 is thicker than coupling member 30 in FIG. 2. A solid top hook member removes the need to use an adhesive for the belt clip structure.

Figure 8:
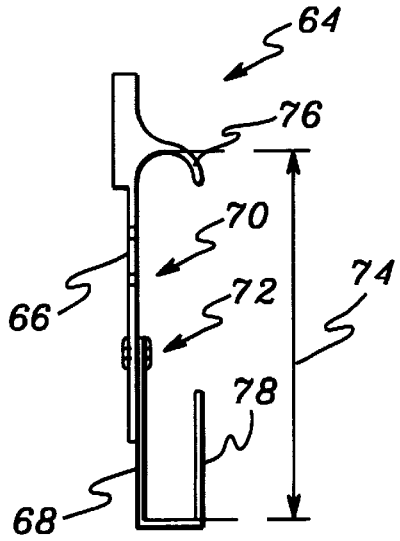
FIG. 8 is a side view of an adjustable version of the belt clip of FIG. 3.

FIG. 8 is a side view of an adjustable belt clip 64 in accordance with the present invention. Specifically, belt clip 64 is an adjustable version of belt clip 32 from FIG. 3. Belt clip 64 comprises similar elements to belt clip 32, except that the straight member is broken up into straight member portions 66 and 68. Portion 66 comprises more than one spaced opening (e.g., opening 70) to accept fastening member 72, which could be, for example, a "Chicago screw" or other type of reliable fastener. Other possible adjusting schemes include, for example, a series of snaps instead of openings (e.g., one male snap member attached to straight portion 68 with more than one female snap member spaced along portion 66), and the use of a hook and loop closure. One skilled in the art will be able to devise various other equivalent schemes to attach portions 66 and 68. In this way, distance 74 between hook members 76 and 78 can be adjusted to correspond to the particular belt being worn.

Figure 4:
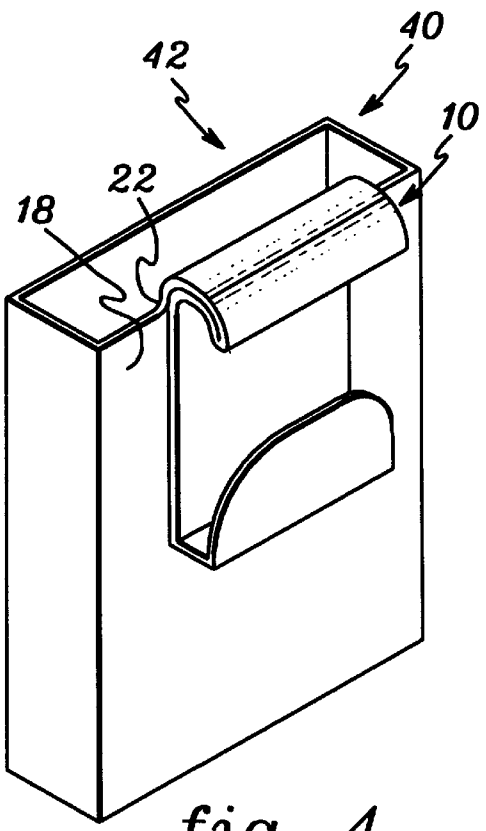
FIG. 4 is depicts a concealed holder including the belt clip of FIG. 1.

FIG. 4 depicts a concealed holder 40, including belt clip 10 from FIG. 1, in accordance with the first embodiment of the present invention. Concealed holder 40 also includes container 42 coupled to belt clip 10 via coupling member 22. Although container 42 is shown generically in FIG. 4 as a rectangular box, it will be understood that container 42 (or containers 46 or 52 in FIGS. 5 and 6, respectively) could take on other shapes. For example, the container could be formed to closely fit a particular object or type of object (such as those described above).

Figure 5:
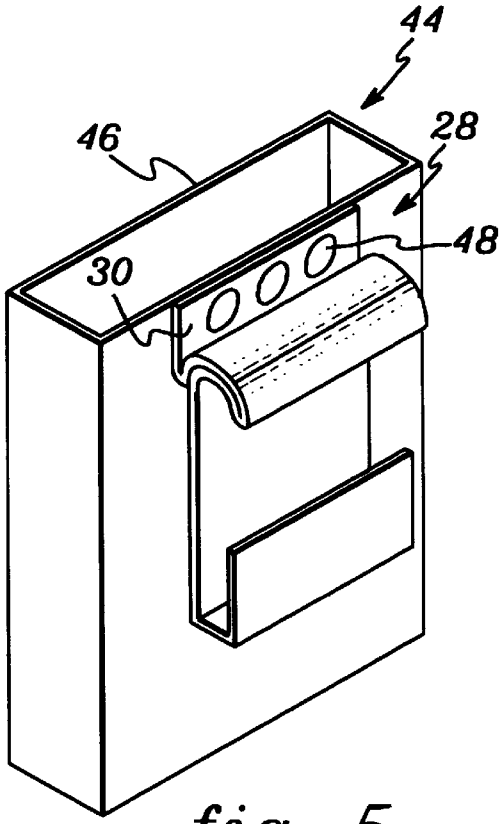
FIG. 5 depicts another concealed holder including the belt clip of FIG. 2.

FIG. 5 depicts another concealed holder 44 in accordance with the second embodiment of the present invention. Concealed holder 44 comprises belt clip 28 from FIG. 2 coupled at coupling member 30 to generic container 46 via a series of rivets (e.g., rivet 48). It will be understood that belt clip 28 could be coupled to container 46 by methods other than riveting, such as, for example, with an adhesive. However, riveting or an equivalent mechanical method is preferred, due to stability concerns.

Figure 6:
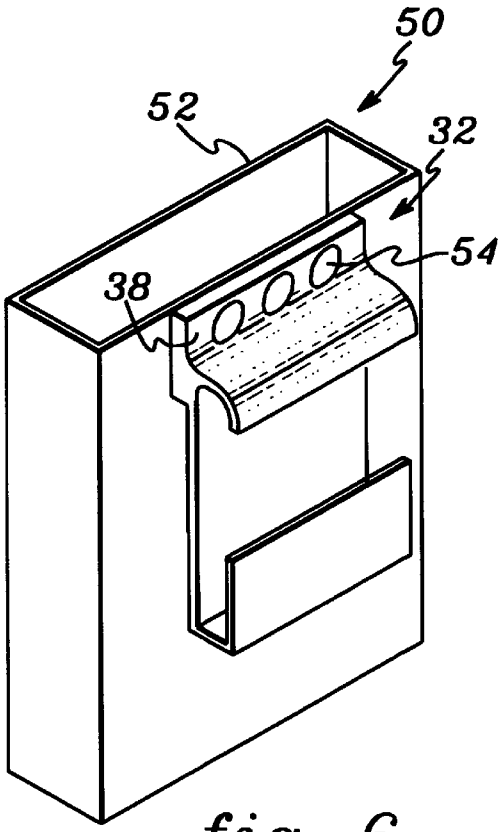
FIG. 6 depicts still another concealed holder including the belt clip of FIG. 3.

FIG. 6 depicts still another concealed holder 50 in accordance with the third embodiment of the present invention. Concealed holder 50 comprises belt clip 32 from FIG. 3 coupled at coupling member 38 to generic container 52 via a series of rivets (e.g., rivet 54). However, as with concealed holder 44 from FIG. 5, it will be understood that belt clip 32 could be coupled to container 52 by methods other than riveting, such as, for example, with an adhesive. However, also as with holder 44, rivets or an equivalent are preferred.

Figure 7:
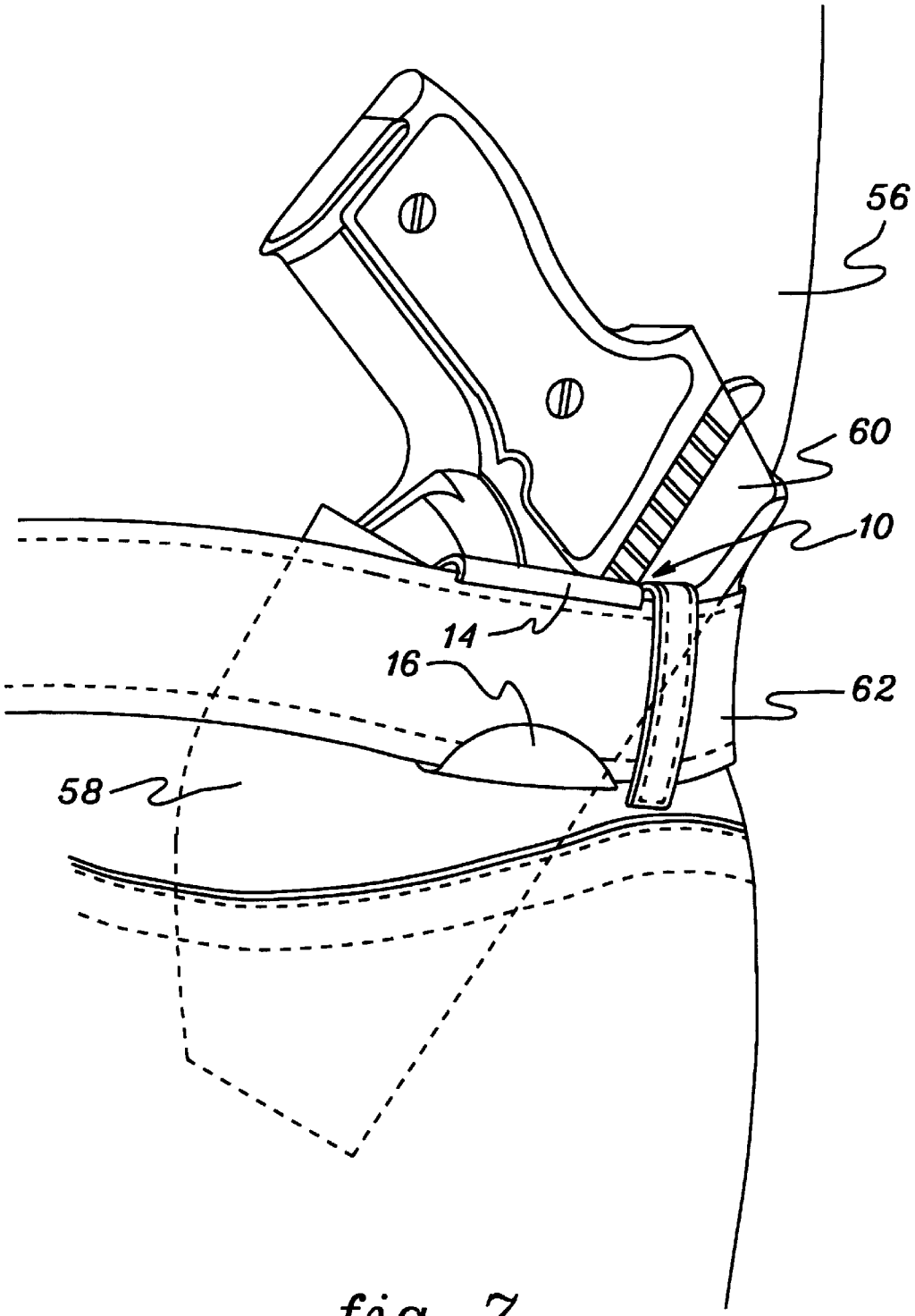
FIG. 7 depicts a concealed hand gun holster in accordance with the first exemplary embodiment of the present invention.

FIG. 7 depicts a user 56 with an inside-the-waistband holster 58 (shown in phantom) for a hand gun 60. Holster 58 is held in place via belt clip 10 from FIGS. 1 and 4 attached to belt 62. FIG. 7 illustrates one of the many practical uses for the invention, as discussed above.

While several aspects of the present invention have been described and depicted herein, alternative aspects may be effected by those skilled in the art to accomplish the same objectives. For example, although the exemplary embodiment herein depict the belt clip of the present invention as being attached to a belt from the pants side, it will be understood that it could be made to attach to the belt from the other side by extending the coupling member. However, such an attachment is not preferred, since it may not be as secure, and reduces the level of concealment. Accordingly, it is intended by the appended claims to cover all such alternative aspects as fall within the true spirit and scope of the invention.

I claim:

1. A concealed holder for inside the waistband of a pair of pants worn by a user wearing a belt, the concealed holder comprising:

a container for concealing inside the waistband; and a belt clip coupled to the container for holding onto the belt, the belt clip comprising:

a straight member spaced from and adjacent to the container;

a top hook member coupled to the straight member at a top thereof and protruding in a direction away from the container for holding onto the belt at a top thereof; and a bottom hook member coupled to the straight member at a bottom thereof and protruding in the direction away from the container for holding onto the belt at a bottom thereof, wherein a gap exists between the top hook member and the bottom hook member such that the belt clip is attachable and removable from the belt while the belt is being worn, and wherein the straight member and an outer surface of the container together act as a clip for holding the waistband.

2. The concealed holder of claim 1, wherein the belt clip further comprises a coupling member for coupling the belt clip and the container.

3. The concealed holder of claim 2, wherein the coupling member is riveted to the container.

4. The concealed holder of claim 2, wherein the container and belt clip together comprise a single piece of material.

5. The concealed holder of claim 3, wherein the single piece of material comprises thermoforming plastic.

6. The concealed holder of claim 1, wherein the belt clip has a size approximately corresponding to that of the belt being worn.

7. The concealed holder of claim 1, wherein the top hook comprises a curved top hook.

8. The concealed holder of claim 1, wherein the bottom hook comprises a squared bottom hook.

9. The concealed holder of claim 1, wherein the container and the belt clip together comprise a single piece of material.

10. The concealed holder of claim 9, wherein the material comprises thermoforming plastic.

11. The concealed holder of claim 1, wherein the belt clip is removably connectable to the container.

12. The concealed holder of claim 1, wherein the container is formed to hold a specific type of object.

13. The concealed holder of claim 12, wherein the container comprises a fire arm holster.

14. The concealed holder of claim 1, wherein the belt clip is adjustable to accommodate different sized belts.

* * * * *